US009986786B2

(12) United States Patent
Wang et al.

(10) Patent No.: US 9,986,786 B2
(45) Date of Patent: Jun. 5, 2018

(54) SHOE SOLE AND FOOTWEAR CONSTITUTED THEREOF

(71) Applicant: Anta (China) Co., Ltd., Jinjiang (CN)

(72) Inventors: Youcheng Wang, Jinjiang (CN); Hailin Huang, Jinjiang (CN); Zhiqiang Qiu, Jinjiang (CN); Shaomeng Chen, Jinjiang (CN); Li Yang, Jinjiang (CN); Zhiyi Zheng, Jinjiang (CN)

(73) Assignee: Anta(China) Co. Ltd., Chidian Town, Jinjiang, Fujian (CN)

( * ) Notice: Subject to any disclaimer, the term of this patent is extended or adjusted under 35 U.S.C. 154(b) by 0 days. days.

(21) Appl. No.: 14/249,323

(22) Filed: Apr. 9, 2014

(65) Prior Publication Data

US 2014/0305008 A1 Oct. 16, 2014

(30) Foreign Application Priority Data

Apr. 10, 2013 (CN) ..... 2013 1 0122179

(51) Int. Cl.

| | |
|---|---|
| ***A43B 13/00*** | (2006.01) |
| ***A43B 13/18*** | (2006.01) |
| ***A43B 3/00*** | (2006.01) |
| *A43B 13/22* | (2006.01) |
| *A43B 7/32* | (2006.01) |
| *A43B 13/26* | (2006.01) |

(52) U.S. Cl.

CPC ..... *A43B 13/18* (2013.01); *A43B 3/0042* (2013.01); *A43B 13/184* (2013.01); *A43B 13/186* (2013.01); *A43B 7/32* (2013.01); *A43B 13/223* (2013.01); *A43B 13/26* (2013.01)

(58) Field of Classification Search

CPC ..... A43B 13/18; A43B 13/181; A43B 13/184; A43B 13/186; A43B 3/0042; A43B 13/122; A43B 13/386; A43B 7/32; A43B 13/223; A43B 13/26; A43B 13/182; A43B 13/145

USPC ..... 36/28, 103, 25 R, 102, 29

See application file for complete search history.

(56) References Cited

U.S. PATENT DOCUMENTS

| | | | | |
|---|---|---|---|---|
| 4,481,727 A | | 11/1984 | Stubblefield | |
| 5,005,300 A | * | 4/1991 | Diaz | A43B 1/0072 36/114 |
| 5,461,800 A | * | 10/1995 | Luthi | A43B 13/206 36/114 |

(Continued)

FOREIGN PATENT DOCUMENTS

CN 102258234 A 11/2011

*Primary Examiner* — Katharine Gracz

(74) *Attorney, Agent, or Firm* — Timothy T. Wang; Ni, Wang & Massand, PLLC

(57) ABSTRACT

A new design of shoe sole that includes both a base portion and a base support portion, wherein the base support portion is a base support portion attached underneath to the center area of the base portion. The current design further includes an expansion portion that extends downwardly from the outside rim of the base portion, wherein the expansion portion is elastic, and the bottom surface of the base support portion is higher than the bottom surface of the expansion portion. Footwear made of this type of sole first touch a support surface (ground) with the expansion portion, which forms a first contact region. Further because the expansion portion is located at the outward rim of the base portion, it is easier for the expansion portion to extend to all directions when pressed.

15 Claims, 5 Drawing Sheets

(56) References Cited

U.S. PATENT DOCUMENTS

| | | | | |
|---|---|---|---|---|
| 5,822,886 | A * | 10/1998 | Luthi et al. | 36/28 |
| 7,392,604 | B2 * | 7/2008 | Greene | A43B 3/24 36/25 R |
| 7,565,754 | B1 * | 7/2009 | Acheson | A43B 13/026 36/144 |
| 7,954,259 | B2 * | 6/2011 | Antonelli | A43B 1/0009 36/25 R |
| 8,365,445 | B2 * | 2/2013 | Sink | 36/103 |
| 9,060,569 | B2 * | 6/2015 | Auger | A43B 7/1445 |
| 2010/0071228 | A1 | 3/2010 | Crowley | |
| 2011/0016750 | A1 * | 1/2011 | Crowley et al. | 36/103 |
| 2011/0289799 | A1 * | 12/2011 | Keating | A43B 7/144 36/103 |
| 2012/0036740 | A1 * | 2/2012 | Gerber | A43B 5/02 36/134 |
| 2012/0167416 | A1 * | 7/2012 | Christensen | A43B 3/0057 36/103 |
| 2013/0104423 | A1 * | 5/2013 | Hatfield et al. | 36/103 |

* cited by examiner

SHOE SOLE AND FOOTWEAR CONSTITUTED THEREOF

TECHNICAL FIELD

The inventions disclosed herein generally relate to footwear manufacturing, more specifically to the design of a new type of shoe sole, and footwear constituted thereof.

BACKGROUND OF THE INVENTION

Comfort is a primary consideration for consumers when selecting footwear. A key factor affecting the comfort level of footwear is the design of its sole.

Sole is the primary weight bearing part of footwear. Therefore the structure of the sole directly affects the performance of footwear. Athletes, in particular, have more requirements for a good pair of shoes. They want footwear not only comfortable to wear, but also effective in shock absorption and offer stable support in sports. Such features are critical for athletes to achieve good results in competitions as well as to avoid foot injuries.

Currently, existing technologies for shock absorption focus primarily on increasing the thickness of the sole. Thickened soles do help with shock absorption, but added thickness also makes footwear heavier, which is generally undesirable for sports shoes. Added weight also decreases footwear's anti-skid effect, which lead to poor stability in the sole's weight support capability. Further, thickened sole does not offer good bounce power to an athlete in sports. Such designs do not meet the human biomechanical design requirements and make the sole undesirable for sports footwear.

Therefore, great needs exist for researchers and designers in the footwear industry to develop a sole that provides both good shock absorption and stable weight support.

SUMMARY OF THE INVENTION

The sole disclosed herein provides both effective shock absorption and stable weight support. It further conforms to the biomechanical design principles. Another object is to provide footwear made of the sole discloses herein.

The shoe sole disclosed herein solve the technical issues with a design that includes both a base portion and a base support portion, wherein said base support portion is attached underneath to the center area of said base portion. The current design further includes an expansion portion that extends downwardly from the outside rim of said base portion, wherein said expansion portion is elastic, and the bottom surface of said base support portion is higher than the bottom surface of said expansion portion.

Preferably, when the sole is not in use, the angle between the inward end of the heel section of said expansion portion and the cross section of the sole, which is perpendicular to the longitudinal direction, is substantially 90 degrees, and the angle between the outward end of the heel section of said expansion portion and the cross section of the sole, which is perpendicular to the longitudinal direction, is equal or greater than 90 degrees.

Preferably, when the sole is not in use, the angle between the inward end of the middle section of said expansion portion and the cross section of the sole, which is perpendicular to the longitudinal direction, is smaller than 90 degrees, and the angle between the outward end of the middle section of said expansion portion and the cross section of the sole, which is perpendicular to the longitudinal direction, is smaller than 90 degrees.

Preferably, when the sole is not in use, the angle between the forefoot section of said expansion portion and the cross section of the sole, which is perpendicular to the longitudinal direction, is smaller than 90 degrees.

Preferably, the expansion portion of the sole further includes a plurality of wheel-shaped tubes that extend outward horizontally and are aligned along the longitudinal direction of the sole.

Preferably, the heights for said plurality of tubes decrease along the direction from the heel to the forefoot section.

Preferably, the inward edge of said expansion portion covers the outward edge of said base portion.

Preferably, the bottom surface of said expansion portion and base support portion include anti-skid bump texture.

Preferably, the size and shape of the support portion is determined based on the various foot pressures along the center pressure line (gait line).

The shoe sole disclosed herein includes both a base portion and a base support portion, wherein said base support portion is attached underneath to the center area of said base portion. The current design further includes an expansion portion that extends downwardly from the outside rim of said base portion, wherein said expansion portion is elastic, and the bottom of said base support portion is higher than the bottom surface of said expansion portion.

Because the sole includes an expansion portion, and the bottom of the support portion is higher than the bottom surface of the expansion portion, footwear made of this type of sole first touch a support surface (ground) with the expansion portion, which forms a first contact region. Further because the expansion portion is located at the outward rim of the base portion, it is easier for the expansion portion to extend to all directions when pressed. It allows a first round of shock absorption in both longitudinal and cross-sectional directions. As the pressure on the shoe sole increases, the expansion portion is further deformed and expanded. The base support portion starts its contact with the ground surface. The deformation of both the expansion portion and base support portion allows a second round of shock absorption. When this occurs, the joint support by the expansion portion and base support portion lowers the height of the shoe sole, expands the support area of the outsole, leads to stronger weight support of the wearer, and protects the wearer from injuries.

In addition, the present sole designs are more in line with the principles in kinesiology. When pressed, the expansion portion is easier be deformed and provide the bounce power for runners, which lends support for the wearer to fully explore his or her athletic potentials.

In one preferred embodiment, when the sole is not in use, the angle between the inward end of the heel section of said expansion portion and the cross section of the sole, which is perpendicular to the longitudinal direction, is substantially 90 degrees, and the angle between the outward end of the heel section of said expansion portion and the cross section of the sole, which is perpendicular to the longitudinal direction, is equal or greater than 90 degrees. Such a design improves the buffering effect by the heel section of the expansion portion. Further, after the structure's deformation under pressure, the expansion portion forms a better flat support structure jointly with the base support portion. Such a joint structure provides more stable weight support.

In another preferred embodiment, when the sole is not in use, the angle between the inward end of the middle section of said expansion portion and the cross section of the sole, which is perpendicular to the longitudinal direction, is smaller than 90 degrees, and the angle between the outward end of the middle section of said expansion portion and the cross section of the sole, which is perpendicular to the longitudinal direction, is smaller than 90 degrees. The middle section of a sole is usually the least pressured area. Such a design avoids excessive contact between the middle section and the ground surface. It makes it easier to achieve a stable gait in sports and offers stable support.

Yet in another preferred embodiment, when the sole is not in use, the angle between the forefoot section of said expansion portion and the cross section of the sole, which is perpendicular to the longitudinal direction, is smaller than 90 degrees. Such a forefoot section design improves and provides more stable support to the wearer.

Additionally, the inventions herein provide footwear made of the disclosed sole and an upper attached to the sole. The sole for footwear could be one in any of the preferred embodiments.

Footwear made of the sole disclosed herein offers the same stable weight support and shock absorption capability. As such, they are not reiterated herein.

Figure 1:
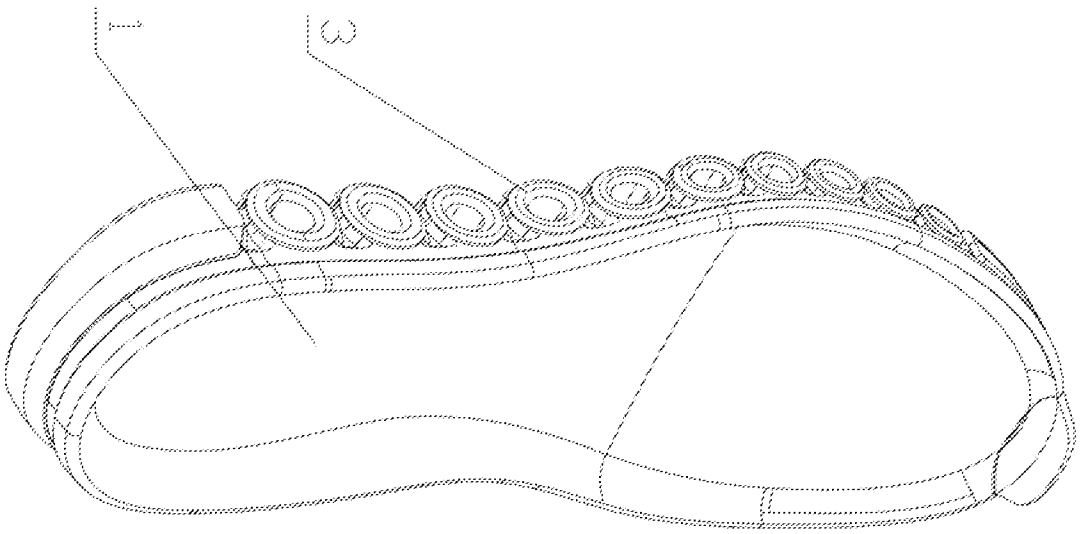
FIG. 1 depicts the structure of a first embodiment of the shoe sole disclosed herein.
Figure 2:
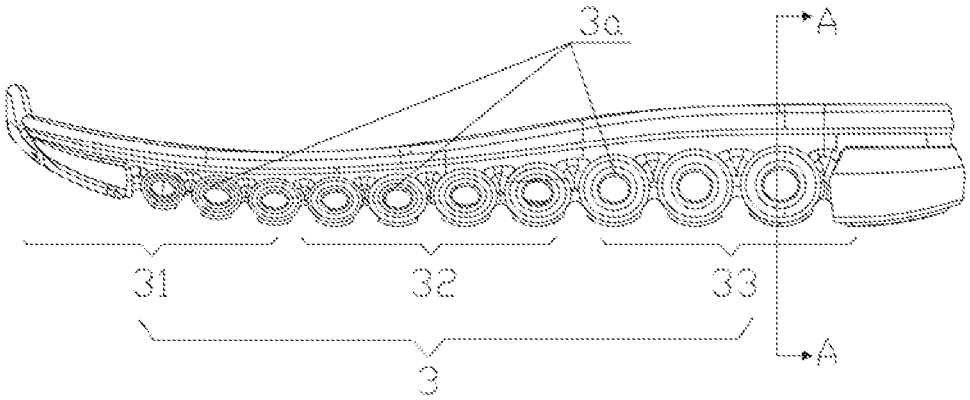
FIG. 2 is a side view schematics of the sole shown in FIG. 1.
Figure 3:
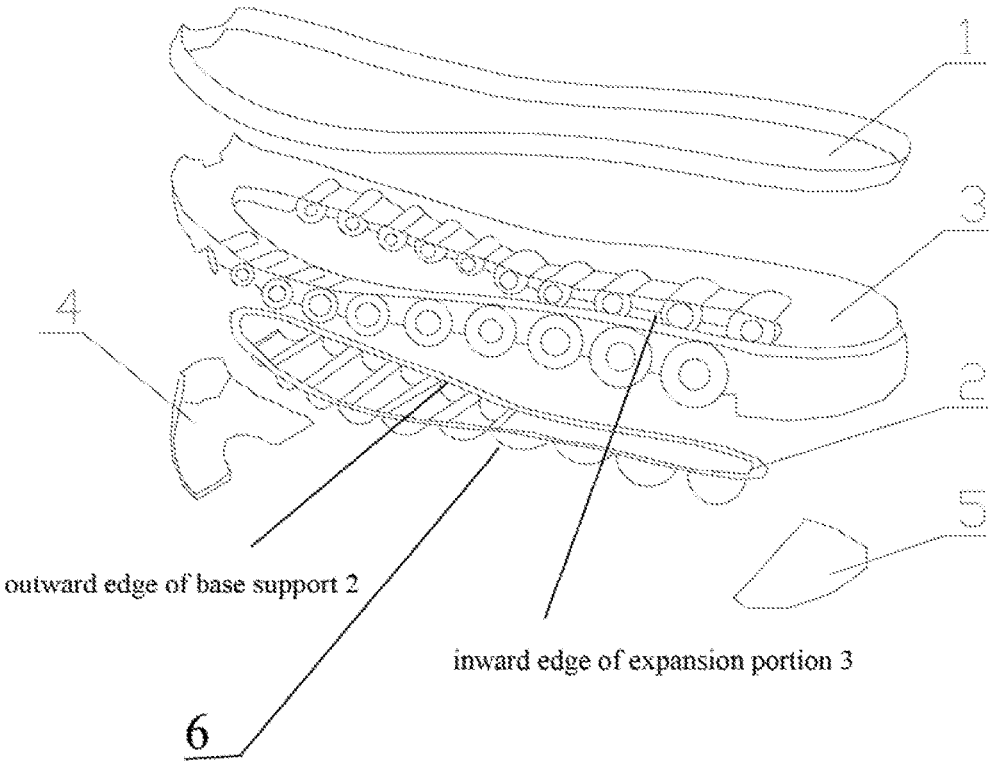
FIG. 3 depicts the structures of individual parts of the sole shown in FIG. 1.

A shown in FIGS. 1-3, the shoe sole include a base portion (1), a base support portion (2), an expansion portion (3), a forefoot section of the expansion portion (31), a middle section of the expansion portion (32), a heel section of the expansion portion (33), a plurality of wheel-shaped tubes (3*a*), a front end connector (4), and a back end connector (5).

DETAILED DESCRIPTION

A primary objective of the inventions disclosed herein is to provide a sole that offers both effective shock absorption and stable weight support. It further conforms to the biomechanical design principles. Another objective is to provide footwear made of the sole disclosed herein.

Figure 4:
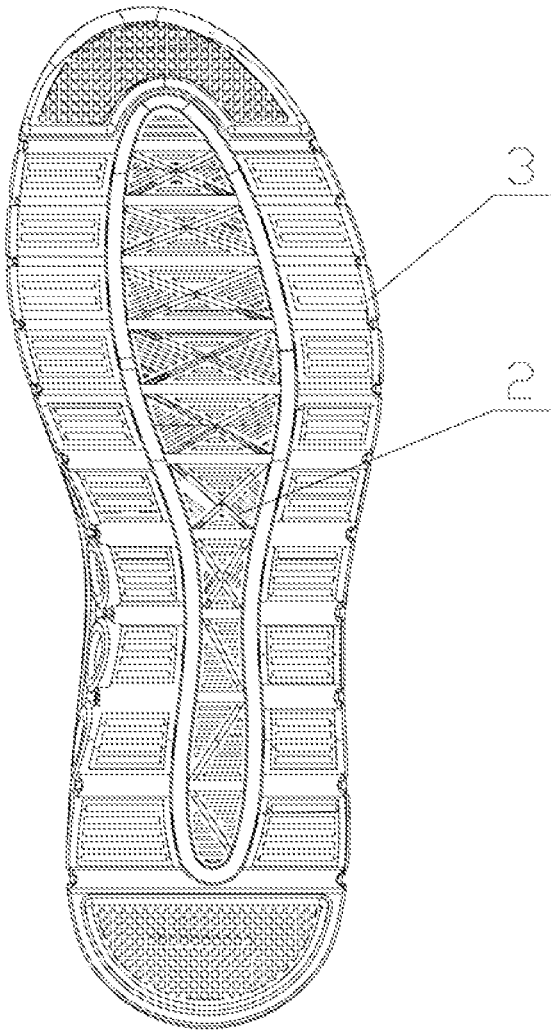
FIG. 4 is a bottom view of the sole shown in FIG. 1.

To facilitate better understanding of the inventions, drawings and preferred embodiments are further described in details as the following:

Referring to FIGS. 1-4, FIG. 1 depicts the structure of a first embodiment of the shoe sole disclosed herein; FIG. 2 is a side view schematics of the sole shown in FIG. 1; FIG. 3 depicts the structures of individual parts of the sole shown in FIG. 1; FIG. 4 is a bottom view of the sole shown in FIG. 1;

The shoe sole disclosed herein includes both a base portion (1) and a base support portion (2). The base portion (1) is usually made of material comfortable to wear. The base support portion (2) is attached underneath to the center area of said base portion. The base support portion could be designed as an extension along the contact surface with the base portion (1). It provides the primary weight support and is usually made of material that is wear-resistant.

The shoe sole disclosed herein further includes an expansion portion that extends downwardly from the outside rim of said base portion, wherein said expansion portion is elastic, and the bottom surface of said base support portion is higher than the bottom surface of said expansion portion.

It's worth noting that the disclosures herein use the normal wear state of a shoe sole in footwear as the reference point. The "bottom surface" referenced herein refers to the side closer to or touching the support surface (ground). Therefore, the statement that "the bottom surface of said base support portion (2) is higher than the bottom surface of said expansion portion (3)" means that the bottom surface of the base support portion is above the bottom surface of the expansion portion. Additionally, the statement is referring to the overall design as a whole. It does not exclude embodiments where parts of the expansion portion (3) are actually higher than parts of base support portion (2). For example, the top of the expansion portion (3) may include bump texture that is higher than part of the base support portion (2).

Because the sole includes an expansion portion and the bottom of the support portion is higher than the bottom surface of the expansion portion, footwear made of this type of sole first touch a support surface (ground) with the expansion portion, which forms a first contact region. Further because the expansion portion is located at the outward rim of the base portion, it is easier for the expansion portion to extend to all direction when pressed. It allows a first round of shock absorption in both longitudinal and cross-sectional directions. As the pressure on the shoe sole increases, the expansion portion is further deformed and expanded, and the base support portion starts its contact with the surface. The deformation of both the expansion portion and base support portion allows a second round of shock absorption. When this occurs, the joint support by the expansion portion and base support portion lowers the height of the shoe sole, expands the support area of the outsole, leads to stronger support of the wearer, and protects the wearer from injuries.

In addition, the present sole design is more in line with the principles of Kinesiology. The expansion portion is easier to be deformed and provides the bounce power for the athletes, which lends support for the wearer to fully explore his or her athletic potentials.

It's also worth noting that the base portion (1) and base support portion (2) are both named from their respective functions. The base portion (1) and base support portion (2) could be either an integrated structure or separate structures during manufacturing. The disclosures herein do not restrict it in any way.

Because different parts of the shoe sole carries different weights of a human body, the expansion portion (3) could be designed as the following to improve its shock absorption capability.

Figure 5:
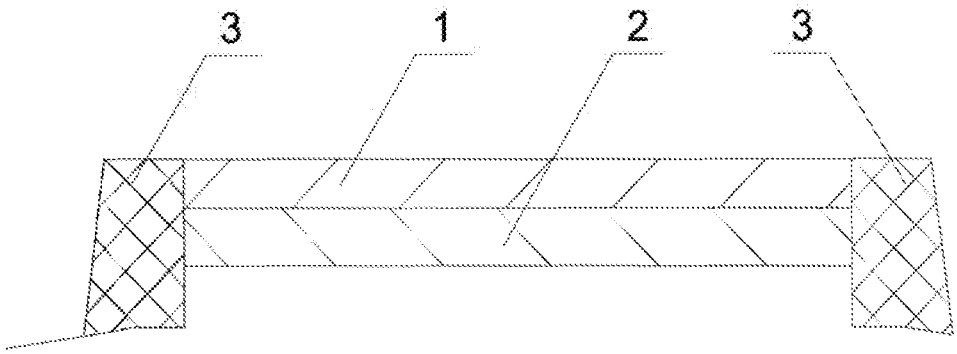
FIG. 5 is a cross section view of the sole shown in FIG. 2.

FIG. 5 is a cross section view of the heel section of the shoe sole shown in FIG. 2.

Generally, the heel section of a shoe sole carries a greater amount of weight during an athlete's movements. In one preferred embodiment, when the sole is not in use, the angle between the inward end of the heel section (33) of said expansion portion and the cross section of the sole, which is perpendicular to the longitudinal direction, is substantially 90 degrees, and the angle between the outward end of the heel section of said expansion portion and the cross section of the sole, which is perpendicular to the longitudinal direction, is equal or greater than 90 degrees. Such a design improves the buffering effect by the heel section of the expansion portion. Further, after the structure's deformation under pressure, it forms a better flat support structure jointly with the base support portion. Such a joint structure provides more stable weight support.

The drawings only show the tilt angle for the heel section of the shoe sole. The angles for the middle and forefoot sections of the shoe sole are similar to the heel section. One of skill in the art can use the illustration in FIG. 5 as reference.

In another preferred embodiment, when the sole is not in use, the angle between the inward end of the middle section (32) of said expansion portion and the cross section of the sole, which is perpendicular to the longitudinal direction, is smaller than 90 degrees, and the angle between the outward end of the middle section of said expansion portion and the cross section of the sole, which is perpendicular to the longitudinal direction, is smaller than 90 degrees. The middle section of a sole is usually the least pressured area. Such a design avoids excessive contact between the middle section and the ground surface. It makes it easier to achieve a stable gait in sports and offers stable support.

Yet in another preferred embodiment, when the sole is not in use, the angle between the forefoot section of said expansion portion and the cross section of the sole, which is perpendicular to the longitudinal direction, is smaller than 90 degrees. Such a forefoot section design improves and provides more stable support to the wearer.

In any of the preferred embodiments, an expansion portion (3) may include a plurality of wheel-shaped tubes (3*a*) that extend outward horizontally and are aligned along the longitudinal direction of the sole. The wheel-shaped tube (3*a*) could be a hollow triangular cylinder or round cylinder structure, or it could be other similar types of hollow tube structures. The cross section areas of the hollow tubes could be the same size or the sizes may vary. Adding wheel-shaped tube-like structure to the expansion portion is beneficial for the first round of shock absorption. It further assists in the deformation process of the expansion portion as it forms a better flat support structure jointly with the base support portion. Such a joint support structure provides more stable weight support.

In addition, the wheel-shaped tube-like structure improves the comfort level for the athletes. It further lowers the weight of the sport footwear, which carries a significant benefit for an athlete during a sports competition or game.

In any of the preferred embodiments, the areas of the heel section (33), middle section (32), and forefoot section (31) of the expansion portion in the same longitudinal cross section may decrease. In other words, the heights for said plurality of tubes decrease along the direction from the heel to the forefoot section. Such a design takes into consideration of the different weights that the various sections need support. The heel section is thicker as it carries the most weight. Accordingly the forefoot is thinner as it carries lesser weight. Such a design further lowers the overall weight of a shoe sole.

It's worth noting that a longitudinal cross section means the longitudinal plane that is perpendicular to the flat bottom surface of the shoe sole.

Without affecting the shock absorption function of the shoe sole, the inward edge of said expansion portion may cover the outward edge of said base portion (1) to offer more stable support. Additionally, the bottom surface of said expansion portion (3) and base support portion (2) may include anti-skid bump textures (6), which not only increase the friction with the ground, but also offer more stable support. It's also beneficial for the aesthetic design of the footwear in consideration of the different dressing codes in various occasions.

In any of the preferred embodiments, the heel section (33), middle section (32), and forefoot section (31) could be made of independent structures. In other words, the expansion portion (3) may not be a continuous structure. Such a design may further decrease the weight of the sole and meet the design requirements for a light weight shoe, which is beneficial for an athlete to explore his or her athletic potentials. Of course, the heel section (33), middle section (32), and forefoot section (31) could also be manufactured as an integrated structure. In other words, the expansion portion (3) is a continuous structure, which is also good for providing more stable weight support.

In any of the preferred embodiments, the size and shape of the base support portion (2) may be determined based on various foot pressures along the center pressure line (gait line, illustrated as dotted line in FIG. 4) in compliance with the human biomechanics. Such designs take into consideration of factors in both the kinetics of human body and kinematics. It not only meets the basic functioning requirements for sports footwear, but also facilitates better humanized designs.

In any of the preferred embodiments, the base support portion (2) and expansion portion (3) could be either an integrated structure or separate structures for manufacturing purposes. They may be made of the same or different materials. Of course, the base support portion (2) and expansion portion (3) may also be made of different synthetic materials. In yet another preferred embodiment, the inward edge of said expansion portion covers the outward edge of said base portion. It enhances the connection between the two portions, and further assist in passing the bounce power of the expansion portion (3) gained from the ground to the base support portion (2). Such as design provides more stable support.

To ensure stronger attachment among the base portion (1), the base support portion (2), and the expansion portion (3), one could also add a front end connector or fixer (4) and a back end connector or fixer (5).

Additionally, the inventions herein further provide footwear made of the disclosed sole and an upper attached to the sole. The sole for footwear could be one disclosed in any of the preferred embodiments.

Footwear made of the sole disclosed herein offers similar stable weight support and shock absorption capability. Therefore, they are not reiterated herein.

Other aspects of the footwear are compatible with the current technologies in footwear manufacturing, and one could refer to the current state of relevant techniques.

Although various exemplary embodiments of the shoe sole and footwear of the present inventions have been illustrated in the accompanying drawings and described in the foregoing detailed description, it will be understood that the inventions disclosed herein are not limited to the embodiments disclosed, but is capable of numerous rearrangements, modifications, and substitutions without departing from the spirit and principles of the inventions as set forth and defined by the following claims.

The invention claimed is:

1. A shoe sole comprising:

a base portion having an outside rim;

a separate base support portion attached underneath to a center area of said base portion and is adapted to contact a ground surface when pressed, and said base support portion having a bottom surface adapted to contact the ground surface when pressed;

a plurality of anti-skid bump textures connected to the bottom surface of the base support portion in a continuous horizontal alignment from a heel to a forefoot section to increase friction with the ground and offer more stable support;

a separate expansion portion that is attached to the outside rim of said base portion and having a single through hole that extends downwardly from the outside rim of said base portion wherein said expansion portion is elastic, the bottom surface of said base support portion is higher than a bottom surface of said expansion portion, and said expansion portion covers an entire outside edge of the base support portion and is adapted to first contact the ground surface when pressed, then jointly contact the ground surface with the base support portion when further pressed, and wherein said base support portion and said expansion portion provides joint shock absorption; and a plurality of anti-skid bump textures connected to the bottom surface of the expansion portion;

wherein said base portion forms a top layer of a shoe sole; and wherein said expansion portion includes hollow cylindrical wheel-shaped tubes extending in a continuous horizontal alignment from the heel to the forefoot section to match and surround the periphery of said base support portion and can extend to all directions when pressed, and both expansion portion and base support portion are attached to the bottom of said base portion and forms a bottom layer of the shoe sole.

2. A shoe sole according to claim 1 wherein an angle between an inward end of a heel section of said expansion portion and a cross section of said expansion portion, which is perpendicular to a longitudinal direction of the sole, is substantially 90 degrees when not in use, and an angle between an outward end of the heel section of said expansion portion and the cross section is equal or greater than 90 degrees.

3. A shoe sole according to claim 1 wherein an angle between an inward end of a middle section of said expansion portion and a cross section, which is perpendicular to a longitudinal direction of the sole, is smaller than 90 degrees when not in use, and an angle between an outward end of the middle section of said expansion portion and the cross section, which is perpendicular to the longitudinal direction of the sole, is smaller than 90 degrees.

4. A shoe sole according to claim 1 wherein an angle between the forefoot section of said expansion portion and a cross section, which is perpendicular to a longitudinal direction of the sole, is smaller than 90 degrees.

5. A shoe sole according to claim 1 wherein said expansion portion further comprising a plurality of wheel-shaped tubes that extend outward horizontally and are aligned along a longitudinal direction of the sole.

6. A shoe sole according to claim 5 wherein the heights for said plurality of tubes decrease along a direction from the heel to the forefoot section.

7. A shoe sole according to claim 1 wherein an inward edge of said expansion portion covers an outward edge of said base portion.

8. Footwear with a shoe sole according to claim 1 further comprising a shoe upper.

9. Footwear with a shoe sole according to claim 2 further comprising a shoe upper.

10. Footwear with a shoe sole according to claim 3 further comprising a shoe upper.

11. Footwear with a shoe sole according to claim 4 further comprising a shoe upper.

12. Footwear with a shoe sole according to claim 5 further comprising a shoe upper.

13. Footwear with a shoe sole according to claim 6 further comprising a shoe upper.

14. Footwear with a shoe sole according to claim 7 further comprising a shoe upper.

15. Footwear with a shoe sole according to claim 7 further comprising a shoe upper.

* * * * *